US007703866B2

(12) United States Patent
Benz et al.

(10) Patent No.: US 7,703,866 B2
(45) Date of Patent: Apr. 27, 2010

(54) ARTICLE SUPPORT DIVIDER SYSTEM

(75) Inventors: Thomas Benz, Neu-Ulm (DE); Jonathan Grey, New Bern, NC (US); Matthew Ricket, New Bern, NC (US); Martin Wagner, Nattheim (DE)

(73) Assignee: BSH Home Appliances Corporation, Huntington Beach, CA (US)

( * ) Notice: Subject to any disclaimer, the term of this patent is extended or adjusted under 35 U.S.C. 154(b) by 165 days.

(21) Appl. No.: 11/290,278

(22) Filed: Nov. 30, 2005

(65) Prior Publication Data

US 2007/0120452 A1 May 31, 2007

(51) Int. Cl.
*A47B 96/00* (2006.01)

(52) U.S. Cl. ..... 312/408; 312/410; 312/348.3; 211/184

(58) Field of Classification Search ..... 312/408, 312/410, 348.3, 404, 116; 108/153.1, 157.13, 108/158.12; 211/184, 183; 220/528–529, 220/532–533
See application file for complete search history.

(56) References Cited

U.S. PATENT DOCUMENTS

| | | | | | |
|---|---|---|---|---|---|
| 1,204,347 | A * | 11/1916 | De Canio | ..... | 312/290 |
| 1,964,831 | A * | 7/1934 | Rein | ..... | 312/408 |
| 2,140,611 | A * | 12/1938 | Smith et al. | ..... | 312/408 |
| 2,505,322 | A * | 4/1950 | Drake | ..... | 312/408 |
| 3,255,987 | A * | 6/1966 | Gatch | ..... | 211/184 |
| 4,341,314 | A * | 7/1982 | Feuerstein | ..... | 211/184 |
| 4,440,458 | A * | 4/1984 | Berkman | ..... | 312/348.3 |
| 4,744,612 | A * | 5/1988 | Winter et al. | ..... | 312/140 |
| 5,441,709 | A * | 8/1995 | Berry, Jr. | ..... | 206/370 |
| 6,023,024 | A * | 2/2000 | Stjerneby | ..... | 211/184 |
| 6,082,557 | A * | 7/2000 | Leahy | ..... | 211/184 |
| 6,244,447 | B1 * | 6/2001 | Frieze et al. | ..... | 211/184 |
| 6,331,280 | B1 * | 12/2001 | Wood | ..... | 422/300 |
| 2002/0179556 | A1 * | 12/2002 | Osawa | ..... | 211/184 |
| 2003/0132178 | A1 * | 7/2003 | Jay et al. | ..... | 211/184 |
| 2005/0082956 | A1 * | 4/2005 | Leistner et al. | ..... | 312/408 |
| 2006/0226104 | A1 * | 10/2006 | Schmidt | ..... | 211/184 |

FOREIGN PATENT DOCUMENTS

| | | | | |
|---|---|---|---|---|
| DE | 3810531 | * 10/1989 | ..... | 312/348.3 |
| EP | 116013 | * 8/1984 | ..... | 312/348.3 |
| EP | 510942 | * 10/1992 | ..... | 211/184 |

* cited by examiner

*Primary Examiner*—Hanh V Tran
(74) *Attorney, Agent, or Firm*—James E. Howard; Andre Pallapies

(57) ABSTRACT

An article support divider system includes a base for supporting articles thereon. The base includes a matrix of openings. Supporting members include a lower portion sized for being press fit into selected respective ones of the openings. A receiving slot is also provided on the receiving members to receive at least one divider plate in a substantially vertical orientation on the surface of the base for dividing the base into different storage regions. In a more specific aspect, a divider system is provided for use within a refrigerator, including at least one of the freezer compartment or refrigerator compartment thereof. The divider system also can be utilized in walls or the ceiling of the compartment with a plurality of openings formed therein.

18 Claims, 3 Drawing Sheets

ARTICLE SUPPORT DIVIDER SYSTEM

FIELD OF THE INVENTION

The invention relates to an article support divider system for dividing a base or side support such as a shelf into multiple regions wherein articles supported thereon can be maintained in an organized manner. In a more specific aspect, the invention relates to such an article support divider system which can be used as shelves in a refrigerator/freezer, both in the refrigerator compartment as well as in the freezer compartment. Yet still further, the invention relates to such a system wherein the dividers can be arranged on the shelves or walls in a simple manner and the shelves or walls can be used in a refrigerator compartment or a freezer compartment of a refrigerator/freezer in a manner in which they do not impede to any substantial extent the flow of cooling air being passed throughout the compartment in which the system is used.

BACKGROUND OF THE INVENTION

In appliances for circulated air cooling, the cooling air cooled by a central evaporator and conveyed by a fan is conducted by a so-called multi-flow system into a storage chamber, be it the refrigerator or the freezer chamber, to be cooled in order to even up the temperature distribution in the storage chamber and to ensure adequate cooling even when there is a high degree of occupancy of articles to be cooled in the storage chamber.

It is often the case in such systems that a series of shelves are arranged both in the refrigerator as well as in the freezer compartment. Such shelves are typically made of glass or like solid material. The shelves are also of flat configuration and generally require that a user of the refrigerator be very organized in keeping the articles in a specifically arranged configuration for ease of access thereto.

A significant and often overlooked problem with such an arrangement of shelves is that because of the solid and non-permeable nature of the shelves, they generally impede the flow of cooling air throughout the compartment such that oftentimes, the flow is non-uniform leading to uneven cooling and possibly spoilage of articles therein. This is further complicated by the fact that it is often desirable to have the shelves occupy substantially an entire plane of the cooling compartment in which the shelf is supported to maximize storage space.

A further shortcoming of such shelves is that because they are generally formed as a flat supporting panel, it is often very easy to store articles thereon in a completely disorganized manner, often overfilling the shelf and complicating access to articles stored thereon.

BRIEF SUMMARY OF THE INVENTION

The present invention provides an adjustable article support divider system which is easy to assemble, generally inexpensive to manufacture and which provides a simplified arrangement for storing articles thereon in an organized and easy to access manner in areas divided as desired by the user.

In accordance with another feature of the invention, such an adjustable article support divider system is provided, in particular for use in cooling storage, especially in a refrigerator in one or both of the freezer and refrigerating compartments thereof, and which allows a well distributed flow of cooling air therethrough with minimal impedance of the flow while still maintaining articles stored thereon in an organized and easy to access manner with spacing between easily adjustable dividers.

These and other features, only a few of which have been set forth, and which are not intended to be all exhaustive, are more clearly evident from the following discussion.

In one aspect, there is provided an adjustable article support divider system which includes at least one base for supporting articles thereon. The base is made up in part of a matrix of openings throughout the surface thereof. At least one moveable supporting member has a lower portion sized for being press-fit into at least one of the openings of the matrix. The supporting member preferably in one embodiment has at least four sides at the lower portion thereof, and at least two horizontal slots on respective sides thereof proximate the lower portion for receiving edges of the base defining hole in which the supporting member is press-fit for being held securely on the at least one base.

The supporting member further includes a vertical slot extending downwardly from the top thereof a predetermined distance for receiving therein an edge of a plate member in a vertical orientation. At least one plate is provided for being received in the slot of the supporting member for being held in a substantially vertical orientation thereby for dividing the base into at least two adjustable regions.

Preferably, the at least one supporting member is a plurality of supporting members for being received in respective ones of the openings in the matrix. While two horizontal slots can be used, three or four, when the base thereof is four-sided, can also be used on respective sides of the supporting members proximate the lower portion for receiving edges of the holes in the matrix therein for holding the supporting member securely on the base.

While the base has been initially described as including a matrix of openings, which as will be clearly evident, facilitates airflow therethrough, the plate can also have a plurality of openings for also allowing free flow of air through the plate to maximize flow both in a vertical and a horizontal direction, especially when used in a cooling chamber.

The base preferably has a raised ridge portion forming a front edge of the base for defining a stop for preventing articles supported thereon from sliding off the base. In one aspect, the base and the plate are formed of metal.

The supporting members are preferably made of elastomeric material for allowing each supporting member to be press fit into one of the openings. Preferably the lower portion is sized an amount slightly larger than the openings sufficient for being allowed to be press therein in a manner sufficiently stable for holding a plate in the slot thereof.

The slot is preferably sized slightly smaller than the thickness of a plate to be held therein and of a depth sufficient to hold the plate in sufficiently stable condition to serve as a divider on the base. In a yet more specific aspect, the supporting member includes a rib extending partially within the vertically extending slot and the plate includes a corresponding mating slot which engages with the rib as the plate is held within the slot of the supporting member.

In a more specific aspect, the system includes a storage compartment holding the divider article support system therein. The storage compartment also includes a base support means for supporting the at least one base in a horizontal position therein. Yet still further, the storage compartment is a cooling compartment. In a yet still further aspect, the storage compartment is a freezer of a refrigerator/freezer. Alternatively, or in combination, the storage compartment is a refrigerator compartment of a refrigerator/freezer. Further, the divider article support system can be secured in the side walls or even a top wall or ceiling of the storage compartment.

BRIEF DESCRIPTION OF THE SEVERAL VIEWS OF THE DRAWING

Having thus briefly described the invention, the same will become more clearly understood with reference to the detailed description which follows, made with reference to the appended drawing, in which.

DETAILED DESCRIPTION OF THE INVENTION

Figure 1:
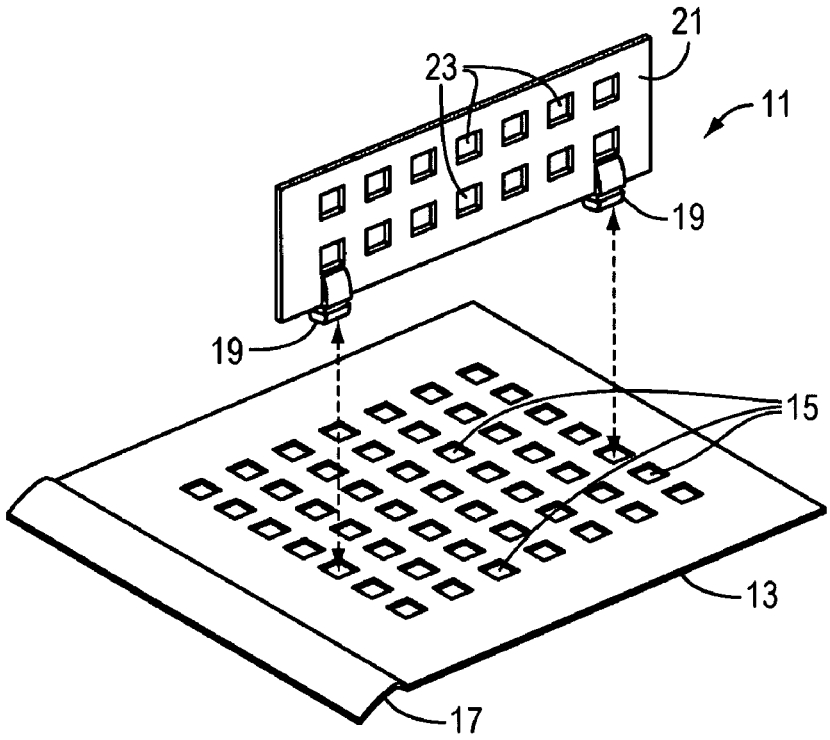
FIG. 1 is an unassembled perspective view of the article support divider system in accordance with the invention.

FIG. 1 shows in unassembled perspective view an article support divider system 11. The article support divider system 11 includes a base or shelf 13 having a matrix of perforations or openings 15, which while shown of generally square or rectangular shape, can take other shapes such as circular, oblong, etc, with supporting members 19 received therein, and being adjusted in shape to correspond thereto. The base or shelf 13 can include at the front thereof a ridge 17 so that when used in a storage compartment, for example, the ridge 17 serves as a stop to keep articles stored on the base or shelf 13 from sliding therefrom. Preferably, the base or shelf 13 is made of metallic or substantially rigid plastic material such as stamped metal suitable for use in a compartment in which it is desired to be used, and capable of withstanding the environmental conditions herein. Similarly, a divider plate 21 can be made of similar material as the base 13.

FIG. 1 also shows a pair of supporting members 19 which engage with the divider plate 21 to be press fit into respective ones of the openings 15 for holding the divider plate 21 in a stable position thereon, to serve as a divider for articles (not illustrated) supported on the base 13. Preferably, the divider plate 21 also includes a plurality of perforations or openings 23, which when combined with the plurality of perforations or openings 15 of the matrix of the base 13, serve to allow free flow of air, in particular cooling air when used in a refrigerator or other cooling compartment, throughout the cooling chamber and in free and substantially unimpeded contact with articles stored on the base 13.

Figure 2:
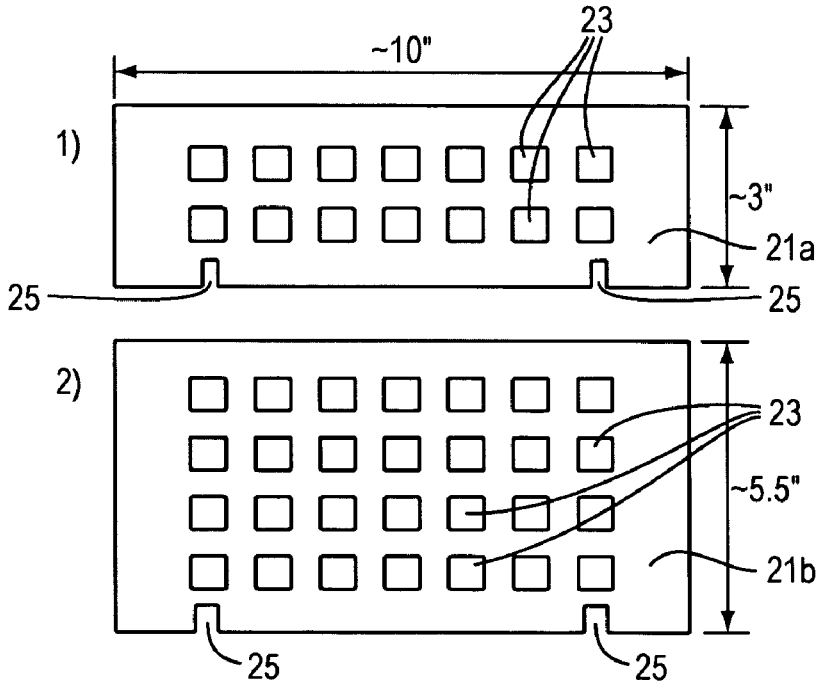
FIG. 2 is a view of two different sized divider plates for the base or shelf.

FIG. 2 shows two sizes of divider plates or panels 21*a* and 21*b* with perforations 23 shown in both dividers 21*a* and 21*b*. Preferably, the divider plates 21*a* and 21*b* include a pair of corresponding slots 25, which are sized to engage with the supporting members 19 as will become more clearly evident from the detailed description thereof provided hereinafter.

Figure 3:
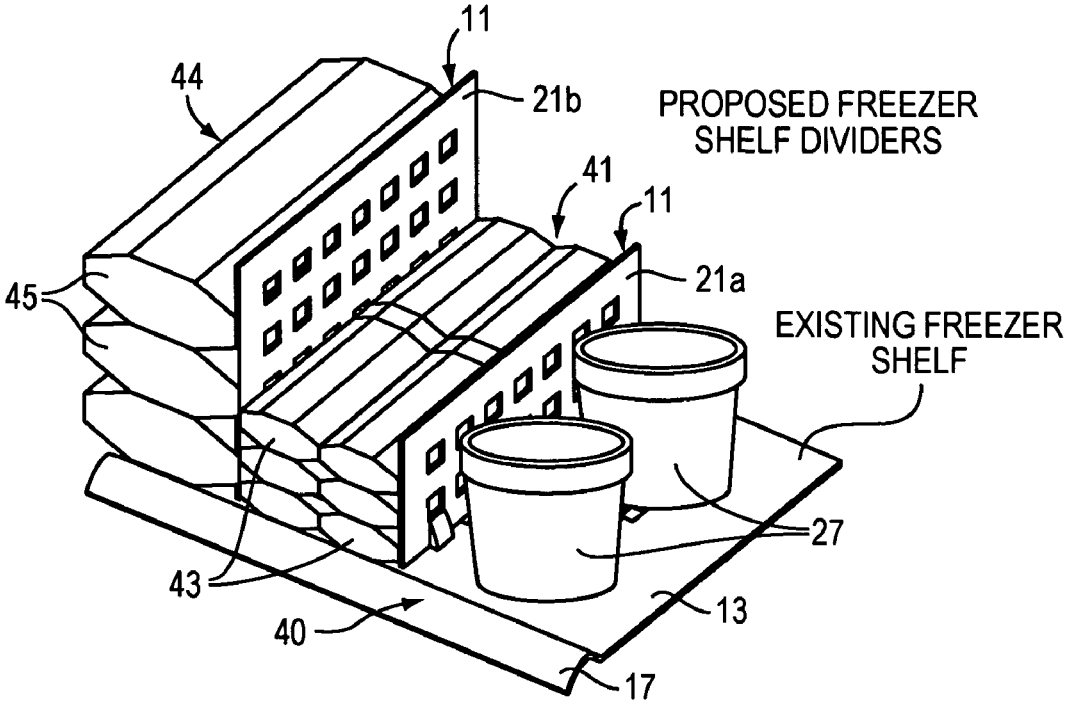
FIG. 3 is a perspective view of an assembled article support divider system in accordance with the invention, showing articles stored thereon in a specifically arranged manner.

Two article support divider systems 11 are shown in an assembled form in FIG. 3 with two different sizes of dividing panels 21*a* and 21*b* shown assembled thereon with a number of articles 27 shown in an easy to access arrangement in a first separated area 40. A second separated area 41 is formed between the two divider panels 21*a* and 21*b* with a second plurality of articles 43 stacked therein. A third separated area 44 is formed on the far side of the panel 21*b* and includes another plurality of articles 45. While the divider panels 21*a* and 21*b* have been shown in a front-to-back configuration, as will be readily apparent to those of ordinary skill in the art, they can be of additional sizes other than the two shown, and can also be arranged in a side-to-side configuration such that a plurality of storage arrangements, including panels both arranged front-to-back and side-to-side can be assembled on the base 13. The ridge 17 is also shown in FIG. 3 clearly illustrating how it serves to prevent articles 27 from sliding off the panel 13.

Figure 4:
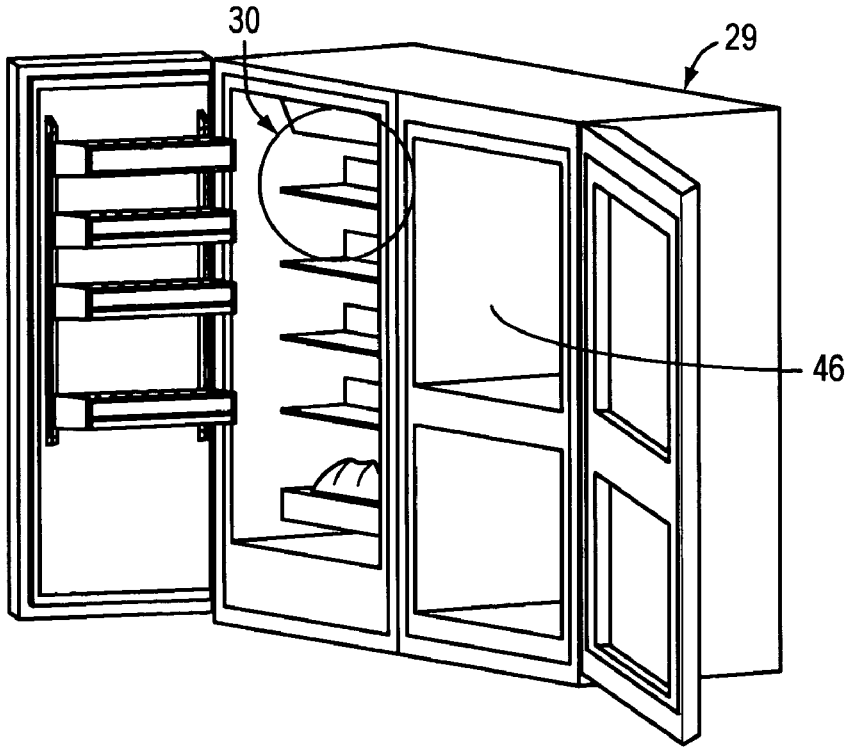
FIG. 4 is a perspective view showing a storage unit such as a refrigerator with the freezer compartment shown in open condition, and indicating where an article support divider system in accordance with the invention would be supported within the storage compartment.

FIG. 4 illustrates in perspective view a refrigerator 29 showing a freezer compartment open with a circled portion indicating where a system such as that of the invention would be supported. As will be readily apparent to those of ordinary skill in the art, such a system can be supported by extensions on the sidewalls of the refrigerator. Alternatively, corresponding grooves can be provided where the base 13 can be slid into the compartment in engagement with the grooves at the side edges thereof. Similarly, engagement notches can be provided in such grooves or other like structures to engage, for example, at the front of the base 13 proximate the ridge 17 to allow the base 13 to be held securely therein without inadvertently sliding out of the compartment.

As will also be readily apparent to those of ordinary skill in the art, the system 11 in accordance with the invention can be used in any type of storage compartment including, the refrigerator portion (not illustrated) of a refrigerator freezer 29 which is shown in FIG. 4 with a refrigerator compartment door 46 closed. Similarly, while specific support arrangements in the compartment have been mentioned, other alternatives which will be readily to those of ordinary still can be employed.

Figure 5:
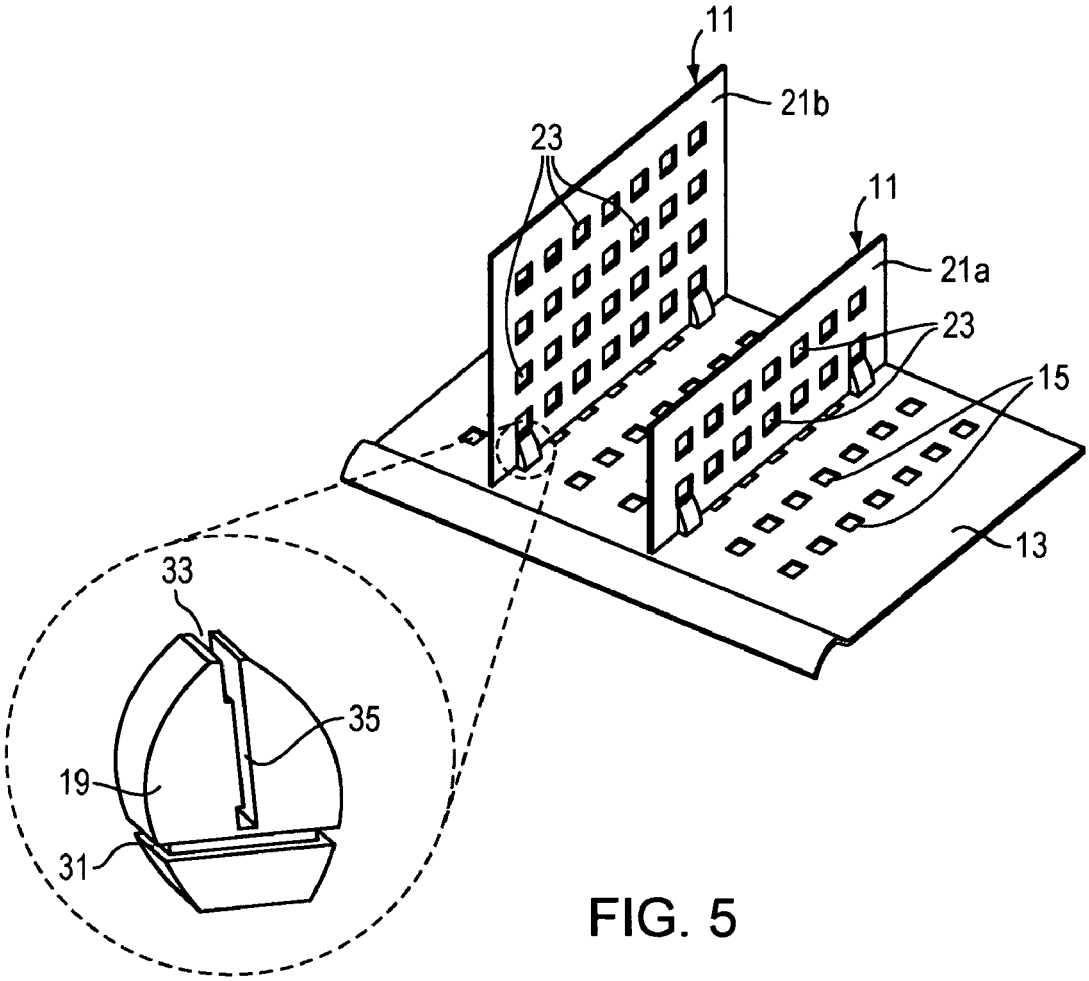
FIG. 5 is a view like FIG. 3 showing the article support divider system in assembled form as in FIG. 3, but with no articles thereon, and showing in enlarged form a supporting member used on the system.
Figure 6:
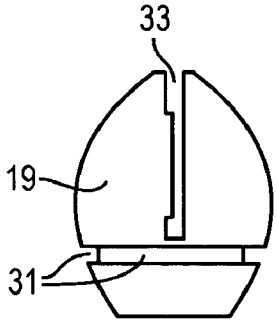
FIG. 6 is a front view of a supporting member used in the system of the invention.
Figure 7:
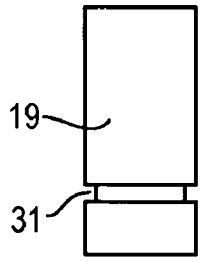
FIG. 7 is a side view of the supporting member.

FIG. 5 illustrates the system 11 of the invention in a view similar to that of FIG. 3, but without the articles 27, 43 and 45 illustrated therein. The two sizes of divider plates 21*a* and 21*b* are shown illustrated therein, as is an enlarged view of the supporting member 19, which is also shown in FIG. 6 in front view and FIG. 7 in side view.

The supporting members 19 include, preferably in corresponding size to the openings 15 of the matrix of the base 13, at least two slots 31 to allow the supporting member 19 which is sized slightly larger than the openings 15 of the matrix at a location proximate the slot 31 to be press-fit into the opening 15 of the matrix, with the edges defining the opening 15 engaged in slots 31. While only two opposing slots 31 are shown, it will be readily apparent to those of ordinary skill in the art that three or four slots can be employed to provide a more secure engagement with the respective edges defining openings 15 of the matrix of the base 13. The slots 31 can also be a pair of slots 31 on adjacent sides (an L-sharped arrangment, not illustrated). When three (see FIG. 6) or four (not illustrated) slots 31 are utilized, then the system 11 is pressed in to the openings 15 and moved laterally against the side of the third slot or either side of the third and fourth slots to securely engage the system 11 in the base plate 13. Similarly, while a general rectangular or four-sided configuration has been shown near the lower portion of the supporting member 19, it can take other shapes as will be readily apparent to those of ordinary skill in the art such as circular, octagonal, pentagonal, etc. Obviously economies of manufacture in relation to the secureness of the engagement desired will dictate the choice of shape.

The supporting member 19 also includes a substantially vertically extending slot 33, as previously discussed. The vertically extending slot 33 receives the plate 21 therein provides a secure engagement. The vertically extending slot 33 also may include a rib 35 within the center thereof extending at least partially the length of the vertically extending slot 33 to engage with slots 25 of the divider plates 21, 21*a* or 21*b*. This provides a more secure arrangement. The size of the slots 25 and the rib 35 are selected to engage in pressed and snug frictional engagement.

The supporting members 19 are preferably made of elastomeric material which is sufficiently compressable to be engaged in a tight fit with the plates 21 and within the openings 15 of the matrix of base 13. Although not illustrated, the system 11 also can be engaged in walls or ceilings of the compartments having a similar plurality of openings 15 formed therein. While of elastomeric material to allow such engagement, the supporting members 19 also have to be of sufficient rigidness to securely be held on the base 13 while holding the plates 21 in a secure manner thereon. As will be evident to those of ordinary skill in the art, the selection of materials can vary and will be chosen in accordance the conditions to which the system 11 of the invention will be subjected. Examples of such elastomeric materials include and are not limited to rubber, and other types of materials such as various compositions of plastics which are currently commercially available.

Having thus generally described the invention, the same will become better understood from the appended claims in which it is set forth in a non-limiting manner.

What is claimed is:

1. A refrigerator shelf divider system comprising:

a base plate defining a planar surface and including a matrix of openings;

a first support having a lower portion sized for being press fit into an opening of said matrix, and the lower portion having a horizontal slot receiving an edge of the base plate defining one of said openings for holding the support securely on said base, and said first support including a vertical slot extending downwardly a predetermined distance from a top of the support;

a second support having a lower portion sized for being press fit into an opening of said matrix, and the lower portion having a horizontal slot receiving an edge of the base defining one of said openings for holding the support securely on said base, and said second support including a vertical slot extending downwardly a predetermined distance from a top of the support; and a divider received in said vertical slot of said first support and said vertical slot of said second support for being held in a vertical orientation for dividing said base plate into regions, said divider includes a plurality of openings and each of said first and second supports including a rib located in their respective vertical slots, the ribs engaging into openings of said divider to limit movement of the divider relative to the first and second supports along the planar surface of the base plate, while allowing movement of the divider relative to the first and second supports in a direction substantially perpendicular to the planar surface of the base plate.

2. The system of claim 1, wherein said base plate has a raised ridge at a front edge of said base plate for defining a stop for preventing articles from sliding off the base plate.

3. The system of claim 1, wherein said base plate includes metal.

4. The system of claim 1, wherein said first and second supports are formed of an elastomeric material.

5. The system of claim 4, wherein said lower portions of said first and second supports are slightly larger than said openings on said base plate and can deform sufficiently for the lower portions to be press fit into said openings on said base plate.

6. The system of claim 4, wherein said vertical slots of the first and second supports are slightly smaller than a thickness of said divider, and of a depth sufficient to hold said divider in sufficiently stable condition.

7. The divider system of claim 1, further comprising a storage compartment including a base support that supports said base plate in a horizontal position.

8. The system of claim 7, wherein said storage compartment is a cooling compartment.

9. The system of claim 7, wherein said storage compartment is a freezer of a refrigerator/freezer.

10. The system of claim 9, wherein said storage compartment is a refrigerator compartment of a refrigerator/freezer.

11. A refrigerator shelf divider system, comprising:

a base plate defining a planar surface and including a matrix of openings;

a plurality of supports, each support comprising:

an elastically deformable lower portion having exterior dimensions that are slightly larger than the openings in the base plate, at least one horizontally extending slot, wherein the lower portion of the support is pressed press fit into an opening of said matrix by slightly deforming the lower portion as it is inserted into the opening until an edge of the base plate defining the opening is received in the at least one horizontally extending slot to hold the support securely on said base, and a vertical slot extending downward a predetermined distance from a top of the support; and a divider received in the vertical slot of at least one support to hold the divider in a vertical orientation so that the divider separates the base plate into regions, the divider including a plurality of openings wherein said at least one support includes a rib located in the vertical slot, the rib engaging into one of said divider openings to limit movement of the divider relative to the at least one support along the planar surface of the base plate, while allowing movement of the divider relative to the at least one support in a direction substantially perpendicular to the planar surface of the base plate.

12. The system of claim 11, wherein the openings in the base plate have a rectilinear shape, and wherein the lower portion of each of the plurality of supports is also rectilinear in shape.

13. The system of claim 12, wherein the at least one horizontally extending slot comprises horizontally extending slots formed on opposite sides of the rectilinear shaped lower portion of the support.

14. The system of claim 12, wherein the at least one horizontally extending slot comprises horizontally extending slots formed on three sides of the rectilinear shaped lower portion of the support.

15. The system of claim 11, wherein each of the plurality of supports includes a rib formed on at least one side of the vertical slot and extending inwards towards a center of the slot.

16. The system of claim 11, further comprising a storage compartment including a base support that supports said base plate in a horizontal position.

17. The system of claim 16, wherein said storage compartment is a freezer of a refrigerator/freezer.

18. The system of claim 16, wherein said storage compartment is a refrigerator compartment of a refrigerator/freezer.

* * * * *